US007594300B2

(12) United States Patent
Nallamottu

(10) Patent No.: US 7,594,300 B2
(45) Date of Patent: Sep. 29, 2009

(54) ADJUSTABLE HINGE

(75) Inventor: Udhaya Bhaskar Nallamottu, Shreveport, LA (US)

(73) Assignee: Hardware Resources, Inc., Bossier City, LA (US)

( * ) Notice: Subject to any disclaimer, the term of this patent is extended or adjusted under 35 U.S.C. 154(b) by 78 days.

(21) Appl. No.: 11/471,195

(22) Filed: Jun. 20, 2006

(65) Prior Publication Data

US 2007/0289093 A1 Dec. 20, 2007

(51) Int. Cl.
*E05D 7/04* (2006.01)

(52) U.S. Cl. ..... 16/236; 16/245; 16/246; 16/247

(58) Field of Classification Search ..... 16/236, 16/237, 238, 370, 360, 336, 246, 245, 247, 16/361, 249

See application file for complete search history.

(56) References Cited

U.S. PATENT DOCUMENTS

| | | | | | |
|---|---|---|---|---|---|
| 3,863,292 | A * | 2/1975 | Grunert et al. | ..... | 16/236 |
| 3,940,829 | A * | 3/1976 | Grunert et al. | ..... | 16/366 |
| 3,952,366 | A * | 4/1976 | Rock et al. | ..... | 16/235 |
| 4,332,053 | A | 6/1982 | Salice | | |
| 4,338,699 | A | 7/1982 | Rock | | |
| 4,383,347 | A | 5/1983 | La Conte | | |
| 4,691,408 | A * | 9/1987 | Rock et al. | ..... | 16/241 |
| 4,703,539 | A * | 11/1987 | Lautenschlager et al. | ..... | 16/240 |
| 4,776,061 | A * | 10/1988 | Franco | ..... | 16/236 |
| 4,837,893 | A * | 6/1989 | Wilson | ..... | 16/240 |
| 5,099,547 | A * | 3/1992 | Salice | ..... | 16/239 |
| 5,159,740 | A * | 11/1992 | Brustle et al. | ..... | 16/258 |
| 5,175,908 | A | 1/1993 | Domenig | | |
| 5,257,437 | A * | 11/1993 | Salice | ..... | 16/239 |
| 5,276,944 | A * | 1/1994 | Lin | ..... | 16/258 |
| 5,369,841 | A * | 12/1994 | Bembnowski | ..... | 16/278 |
| 5,373,609 | A | 12/1994 | Ferrari et al. | | |
| 5,392,493 | A * | 2/1995 | Youngdale | ..... | 16/237 |
| RE34,995 | E | 7/1995 | Domenig | | |
| 5,511,287 | A * | 4/1996 | Lautenschlager et al. | ..... | 16/239 |
| 6,148,479 | A * | 11/2000 | Lin | ..... | 16/258 |
| 6,681,448 | B2 | 1/2004 | Liang | | |
| 6,694,567 | B1 * | 2/2004 | Domenig et al. | ..... | 16/238 |
| 6,757,939 | B2 * | 7/2004 | Mueller et al. | ..... | 16/242 |
| 6,845,544 | B2 | 1/2005 | Hofer | | |
| 2003/0061683 | A1 * | 4/2003 | Migli | ..... | 16/238 |
| 2007/0136988 | A1 * | 6/2007 | Bullock | ..... | 16/245 |

* cited by examiner

*Primary Examiner*—Victor Batson
*Assistant Examiner*—Jeffrey O'Brien
(74) *Attorney, Agent, or Firm*—Schultz & Associates, P.C.

(57) ABSTRACT

An adjustable hinge fixture that includes a base plate for adjustable fixation to an article of furniture, a connecting plate assembly including a generally U-shaped cross-section formed by a top portion and a pair of spaced apart side walls, and an adjustment screw operable to move the connecting plate assembly relative to the base plate about a curved region of the connecting plate assembly. The connecting plate assembly has a projection through a curved region to a lower portion of the projection positioned between the side walls and generally parallel to the top portion. The curved region is elastically deflectable to permit the lower and top portions to move relative to each other. The lower portion is adjustably connected to the base plate.

19 Claims, 6 Drawing Sheets

ADJUSTABLE HINGE

BACKGROUND OF THE INVENTION

1. Field of the Invention

The present invention relates to adjustable hinges and more particularly relates to adjustable hinges and self-closing adjustable hinges that are adjustable in multiple directions.

2. Discussion of the Background

Furniture, such as cabinets or the like, generally must be individually adjusted to compensate for unavoidable manufacturing tolerances. Such adjustment is generally required in two or more dimensions, and if the door has two or more hinges as is usually the case, must be carried out on each hinge with respect to the other hinges. Hinges today generally suffer from various disadvantages including difficulty of installation, undesirable correlation between adjustments in different directions which require multiple readjustments in small increments, coordination of these adjustments collectively with respect to the other hinges, complex construction and correspondingly high manufacturing costs, and instability of the selected adjustments.

Adjustable hinges may but are not required to include self-closing mechanisms. Hinges having self-closing mechanisms are known in the art. For instance, U.S. Pat. Nos. 4,290,167; 4,376,324; 4,716,622; 5,027,474; and 5,617,612 each disclose hinges having a self-closing mechanism. These references are incorporated by reference herein.

Hinges are commonly manufactured with connecting parts of two lengths. The first connecting part length is approximately 65 millimeters and is commonly known as a "long arm." The second connecting part length is approximately 36 millimeters and is commonly known as a "short arm." Today, short arm hinges require a gap of at least 5 millimeters between connected pieces of furniture, such as between a door and a frame, in a closed position.

Thus, as noted above, there currently exists numerous deficiencies in the adjustable hinges that are known in the prior art.

SUMMARY OF THE INVENTION

Accordingly, one aspect of the present invention is to provide an adjustable hinge fixture that includes a base plate for adjustable fixation to an article of furniture, a connecting plate assembly including a generally U-shaped cross-section formed by a top portion and a pair of spaced apart side walls, and an adjustment screw operable to move the connecting plate assembly relative to the base plate about a curved region of the connecting plate assembly. The connecting plate assembly has a projection through a curved region to a lower portion of the projection positioned between the side walls and generally parallel to the top portion. The curved region is elastically deflectable to permit the lower and top portions to move relative to each other. The lower portion is adjustably connected to the base plate.

Another aspect of the present invention is to provide an adjustable hinge that includes an adjustable hinge fixture, a door-related part secured to a second article of furniture, and a linkage means for movably interconnecting the door-related part and the adjustable hinge fixture. The adjustable hinge fixture includes a base plate for adjustable fixation to an article of furniture, a connecting plate assembly including a generally U-shaped cross-section formed by a top portion and a pair of spaced apart side walls, and an adjustment screw operable to move the connecting plate assembly relative to the base plate about a curved region of the connecting plate assembly. The connecting plate assembly has a projection through a curved region to a lower portion of the projection positioned between the side walls and generally parallel to the top portion. The curved region is elastically deflectable to permit the lower and top portions to move relative to each other. The lower portion is adjustably connected to the base plate.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
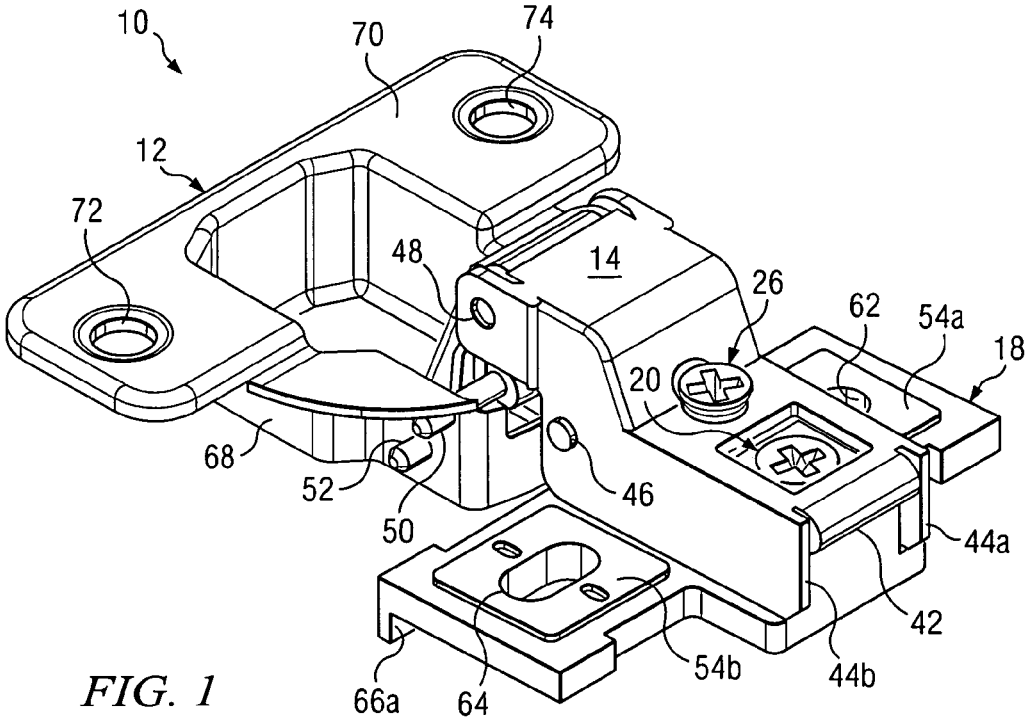
FIG. 1 is a perspective view of an adjustable hinge in an open position according to an embodiment of the present invention.
Figure 2:
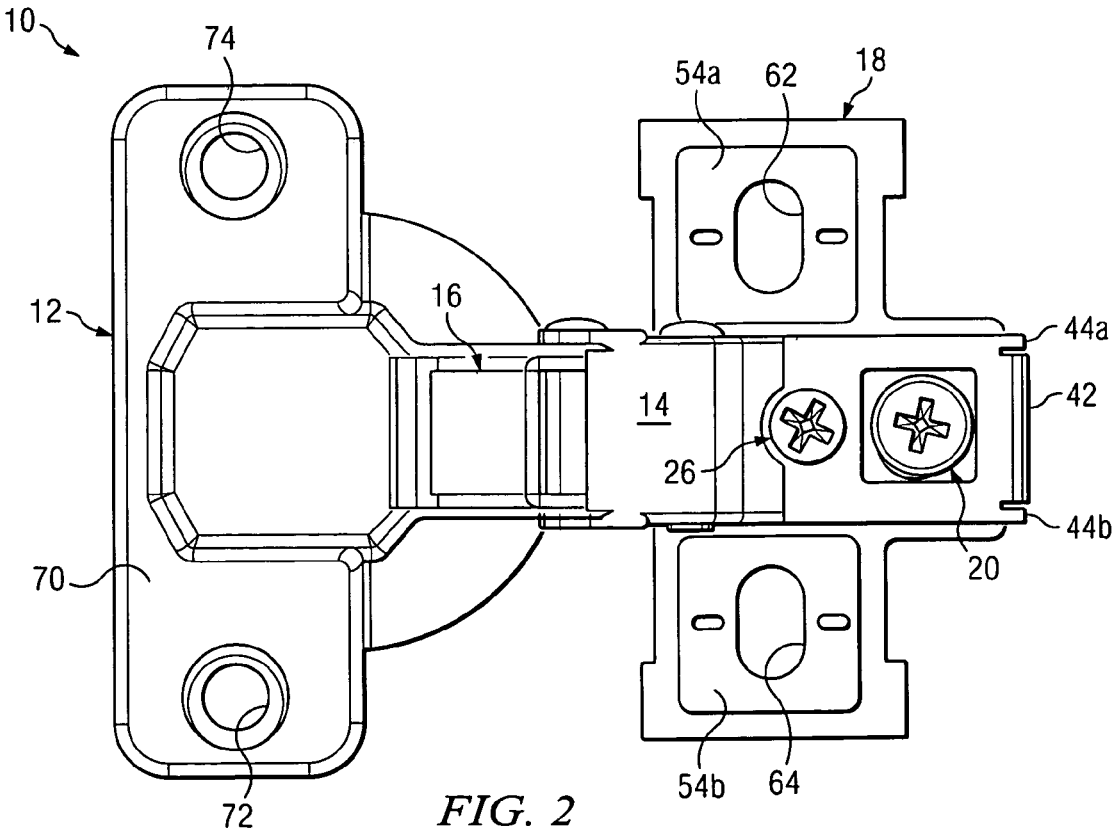
FIG. 2 is a top view of an adjustable hinge in an open position according to an embodiment of the present invention.
Figure 3:
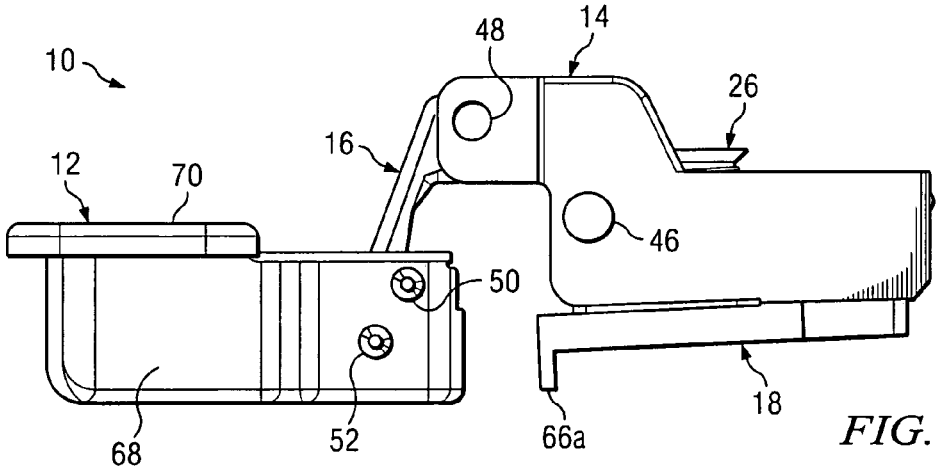
FIG. 3 is a side view of an adjustable hinge in an open position according to an embodiment of the present invention.

Referring now to the drawings, wherein like reference numerals designate identical or corresponding parts throughout the several views, preferred embodiments of the present invention are described.

Referring to FIGS. 1-4 and 8, an adjustable hinge according to an embodiment of the present invention as indicated overall by 10 is shown. The adjustable hinge 10 serves for pivotally connecting a piece of furniture. For instance, in one embodiment, the adjustable hinge 10 may be used to pivotally connect a cabinet door to a door opening of which is confined by a frame. The adjustable hinge may also be a self-closing adjustable hinge. The adjustable hinge 10 includes a door-related part 12, a connecting plate assembly 14, a hinge arm 16 and a base plate 18. In one embodiment, the adjustable hinge 10 is arranged such that the gap between the cabinet door and the door opening is reduced and/or substantially eliminated. The adjustable hinge 10 is also arranged such that its overall longitudinal length is reduced. In one embodiment, the connection plate assembly 14 has a length of approximately 36 millimeters. However, other lengths are possible within the scope of the invention. It is of course to be understood that the present invention is not limited to the above identified connecting components and that other connecting components may be used within the scope of the present invention. Each of the adjustable hinge 10 components may be made from any material. In one embodiment, the components of the adjustable hinge 10 are made from metal formed from pressure casting or stamping.

The door-related part 12 includes a top portion 70 having circular holes 72 and 74, and a cup or disc portion 68. The door-related part 12 is secured to a piece of furniture, such as a cabinet door, by screws, dowels or the like, which are projected through the holes 72 and 74. The cup or disc portion 68 of the door-related part 12 is inserted into a recess of the piece of furniture (e.g., the cabinet door).

The hinge arm or linkage 16 pivotally interconnects, at opposite ends of the hinge arm 16, the door-related part 12 and the connecting plate assembly. The hinge arm 16 is pivotally connected to the door-related part 12 by links 52 and 50 to form a four-bar linkage. Links 52 and 50 protrude through side walls of the cup or disc portion 68 of the door-related part 12. The connecting plate assembly 14 is pivotally connected to the hinge arm 16 by a hinge pin 48. It is of course to be understood that the present invention is not limited to the above-identified connections between the connecting components and that other connections may to used within the scope of the present invention.

Referring to FIGS. 7A-7G, the connecting plate assembly 14 of the adjustable hinge 10 according to an embodiment of the present invention is shown in various perspectives and views. The connecting plate assembly 14 generally has a U-shaped cross-section configuration defined by a pair of opposing side walls 44*a* and 44*b*, and a top portion 35 along a longitudinal center axis. The top portion includes a screw thread opening 36 and an access opening 38. In one embodiment, the access opening 38 has a generally rectangular shape. An elongated portion 42 extends from the top portion 35 through a curved region 41 to an end portion 43 that is substantially parallel to the top portion 35 along the pair of opposing side walls 44*a* and 44*b*. The elongated portion 42 is provided with a cam hole 40 positioned below the access opening 38. According to the present invention, the curved region 41 is configured to allow the top portion 35 to be angularly displaced in a vertical direction relative to the elongated portion 42 as described below.

Figure 5A:
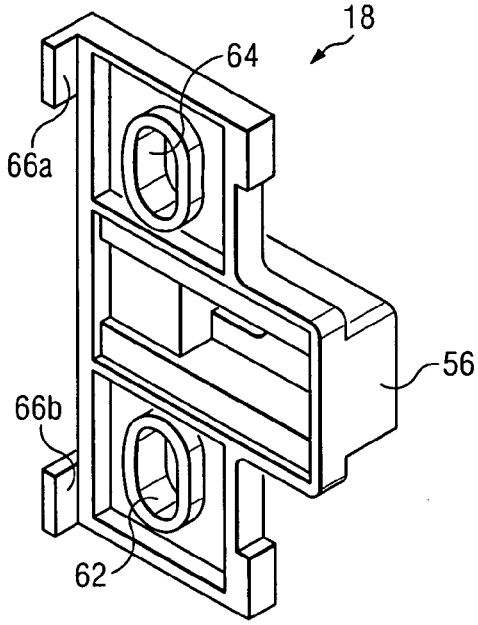
FIG. 5A is a perspective view of a base plate of an adjustable hinge according to an embodiment of the present invention.
Figure 5B:
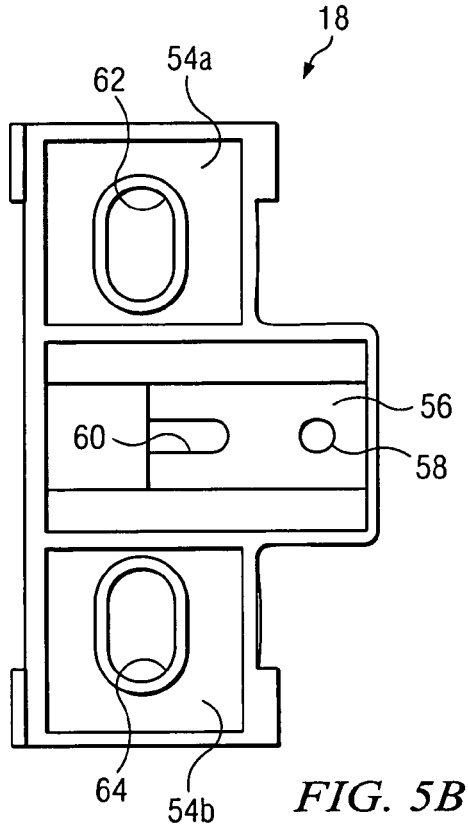
FIG. 5B is a top view of a base plate of an adjustable hinge according to an embodiment of the present invention.

Referring to FIGS. 5A and 5B, perspective and top views of the base plate 18 of the adjustable hinge 10 according to an embodiment of the present invention are respectively shown. The base plate 18 includes an elevated section or boss 56 and wing portions 54*a* and 54*b* that extend transversely of the center axis on opposite sides of the base plate 18.

The elevated section 56 is generally configured such that it may be fitted between the side walls 44*a* and 44*b* of the connecting plate assembly 14. Each connecting wing portion (54*a* and 54*b*) includes an elongated slot (62 and 64) and a downward extending flap (66*a* and 66*b*) which is configured to rest against the door frame at a side facing the door. The base plate 18 is adjustably secured to the frame such that the V-shaped elevated section 56 extends in a direction that is longitudinal of the center axis by screws or the like projected through the elongated slots 62 and 64. The elongated slots 62 and 64 of the base plate 18 are arranged such that base plate 18 may be aligned or properly adjusted on the frame in a direction that is transverse of the center axis. The elevated section 56 includes an elongated open slot 60, extending in a direction that is longitudinal of the center axis, and a cam hole 58. The elongated open slot 60 is configured to hold an adjustment screw 26 in place when the elevated section 56 is positioned between the side walls 44*a* and 44*b* of the connecting plate assembly 14.

Figure 4:
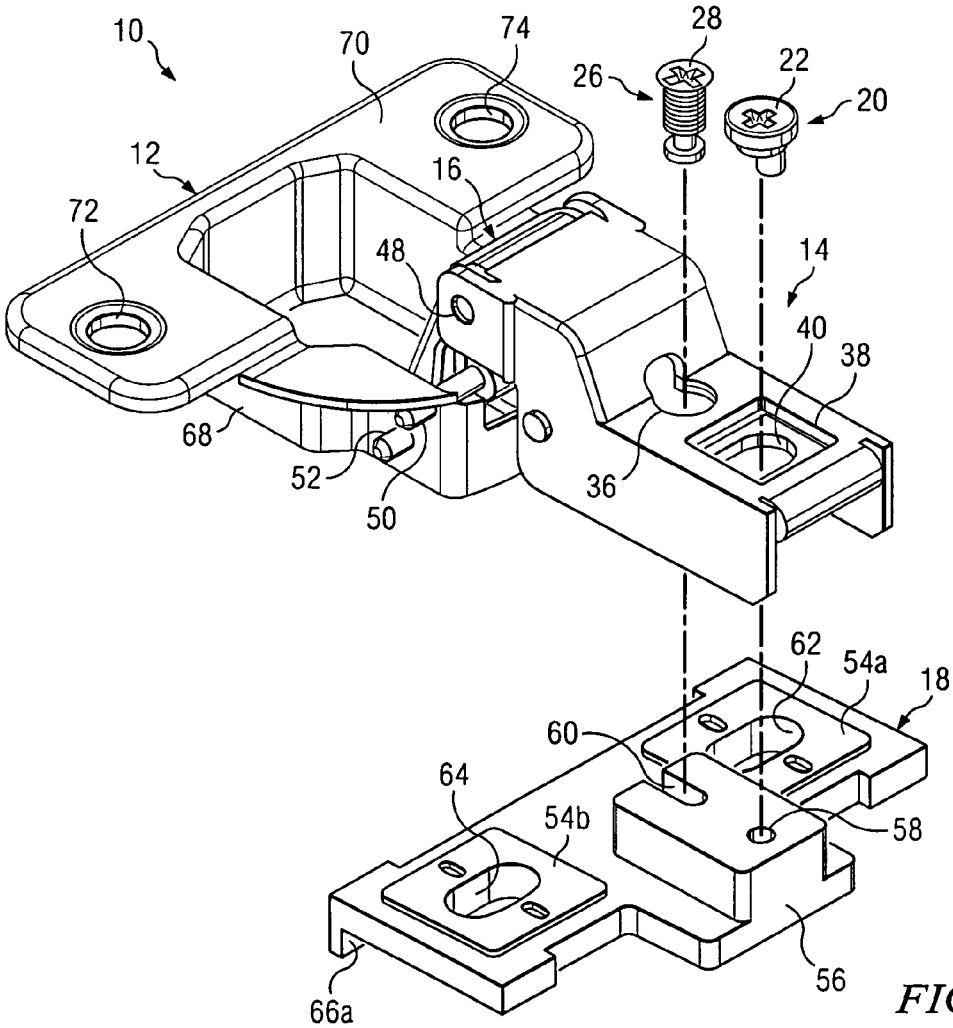
FIG. 4 is an exploded perspective view of an adjustable hinge according to an embodiment of the present invention.
Figure 6A:
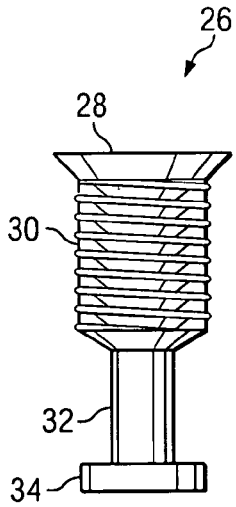
FIG. 6A is a side view of adjustment screw of an adjustable hinge according to an embodiment of the present invention.
Figure 6B:
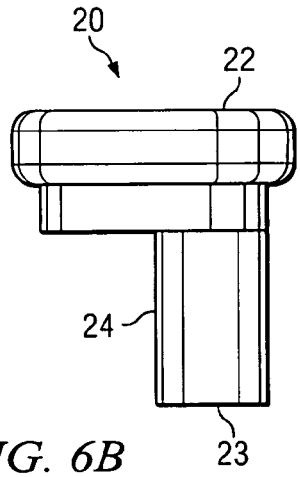
FIG. 6B is a side view of an eccentric of an adjustable hinge according to an embodiment of the present invention.
Figure 7A:
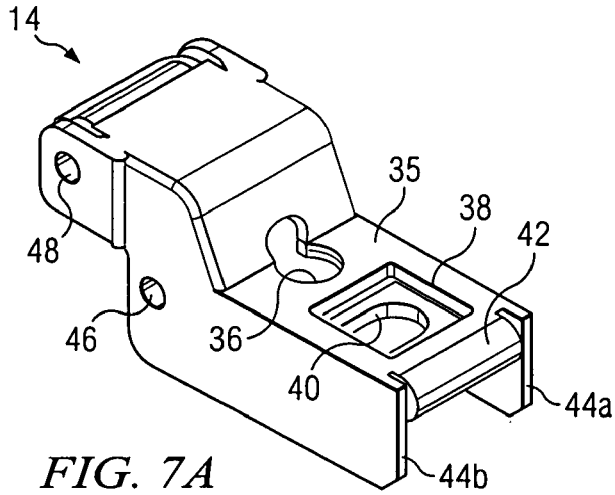
FIG. 7A is a perspective view of a connecting plate assembly of an adjustable hinge according to an embodiment of the present invention.
Figure 7D:
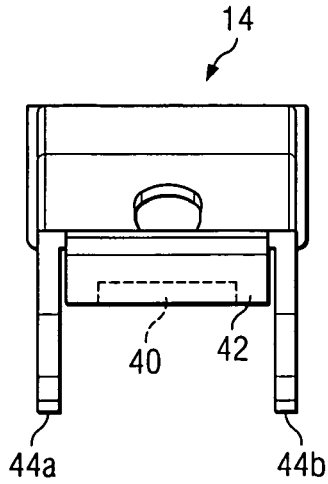
FIG. 7D is a rear view of a connecting plate assembly of an adjustable hinge according to an embodiment of the present invention.
Figure 7B:
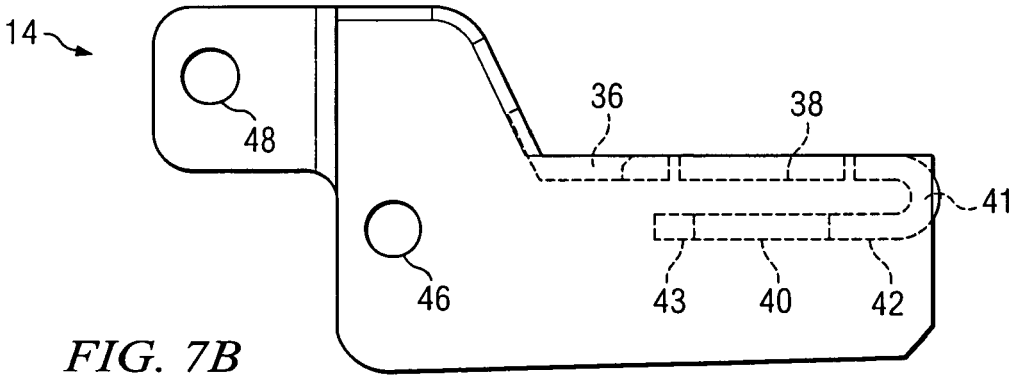
FIG. 7B is a side view, partially in section, of a connecting plate assembly of an adjustable hinge according to an embodiment of the present invention.
Figure 7C:
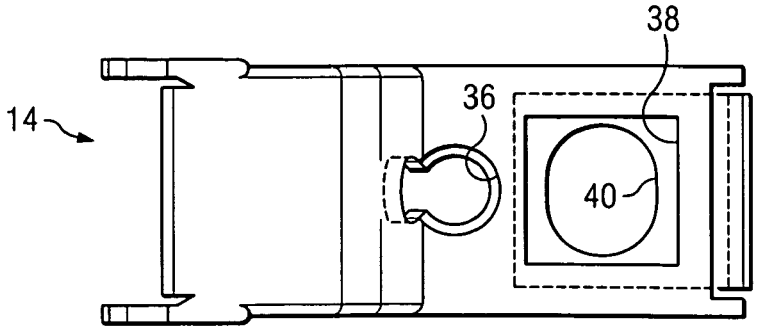
FIG. 7C is a top view of a connecting plate assembly of an adjustable hinge according to an embodiment of the present invention.
Figure 7E:
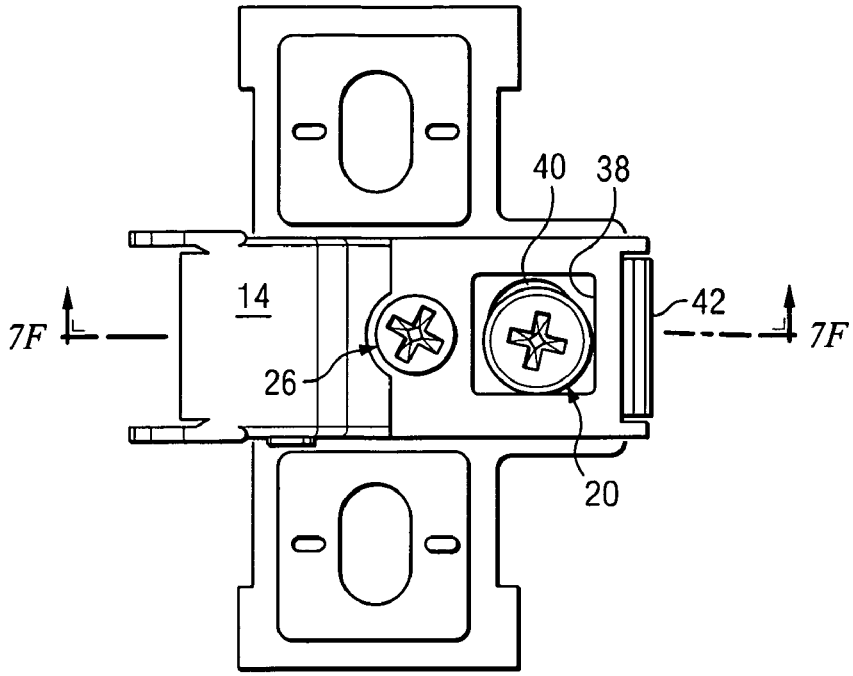
FIG. 7E is a top view of a connecting plate assembly and base plate of an adjustable hinge according to an embodiment of the present invention.
Figure 7F:
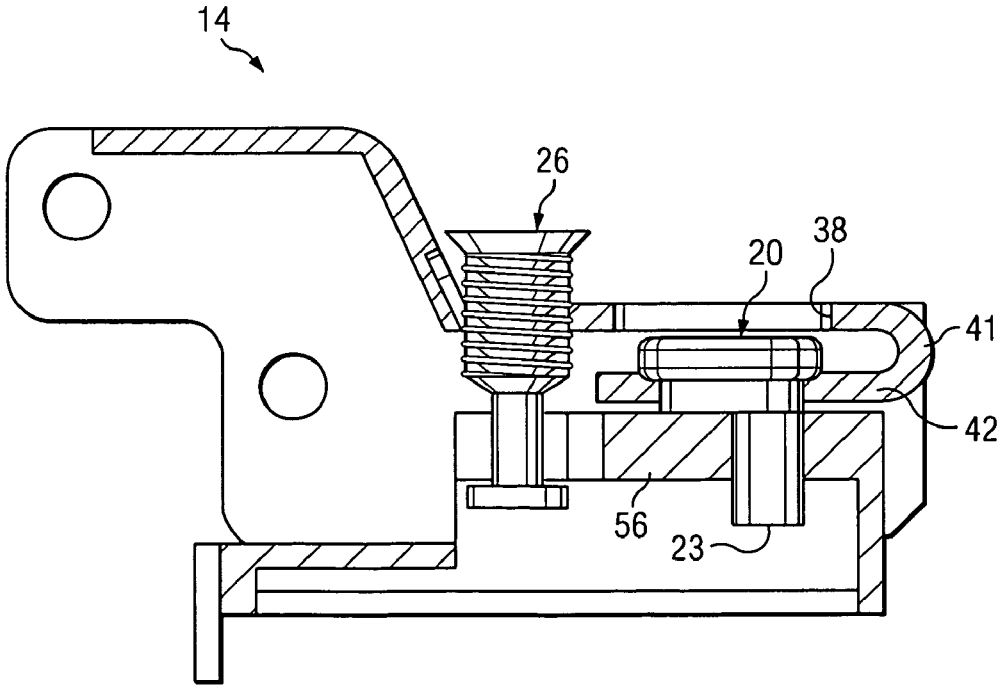
FIG. 7F is a cross-sectional view through the connecting plate assembly and base plate of FIG. 7E according to an embodiment of the present invention.
Figure 7G:
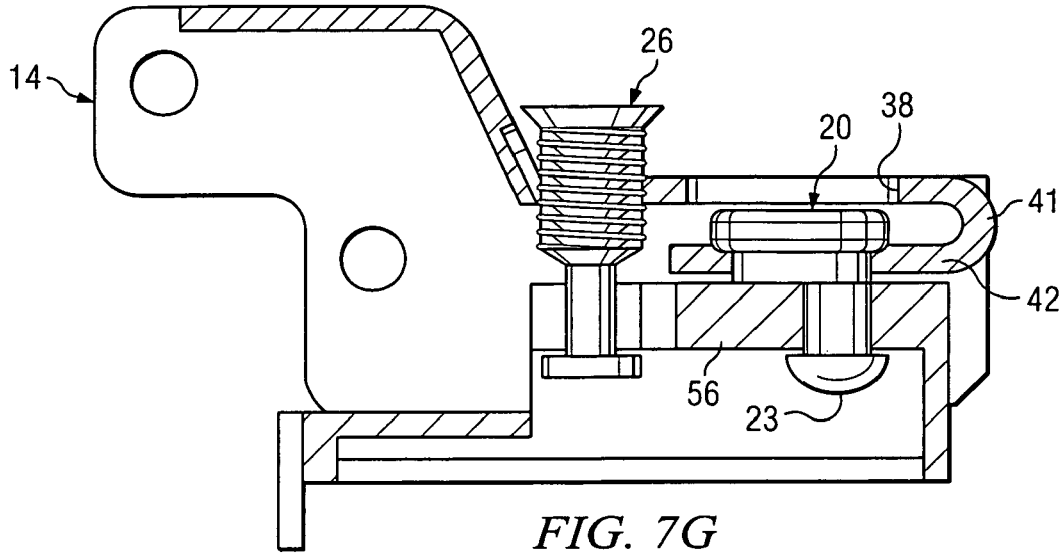
FIG. 7G is a cross-sectional view through the connecting plate assembly and base plate of FIG. 7E illustrating an eccentric having a rivet according to an embodiment of the present invention.
Figure 8:
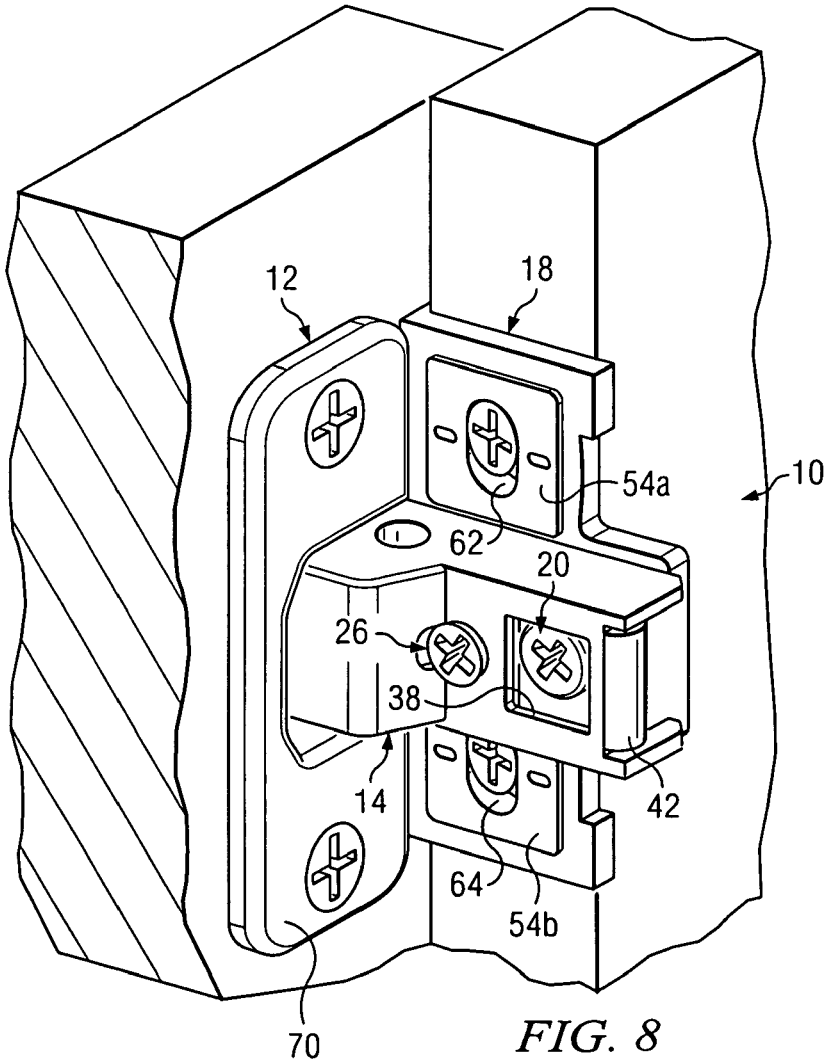
FIG. 8 is a perspective view of an adjustable hinge in a closed position according to an embodiment of the present invention.

As shown in FIGS. 4 and 6B, an eccentric 20 is provided with a screw head 22 and a protruding off-center cam 24. The eccentric 20 movably connects the connecting plate assembly 14 to the base plate 18 with the cam 24 projected through the cam holes 40 and 58 of the connecting plate assembly 14 and the base plate 18, respectively. The eccentric 20 is arranged such that the plate assembly 14 may be aligned or properly adjusted in a longitudinal direction of the center axis. In one embodiment, the elongated portion 42 of the connecting plate assembly 14 is adjustably secured to the base plate 18 between the screw head 22 and a rivet head, larger than the cam hole 58, formed by the deformation of an end portion 23 of the cam 24 using an orbital riveter or the like, as shown in FIG. 7G. Optionally, the eccentric 20 may utilize a bolt or other securing mechanism instead of a rivet head. The components of the adjustable hinge 10 are arranged such that turning the screw head 22 of the eccentric 20 results in the displacement of the connecting plate assembly 14 on the base plate 18 in a direction that is longitudinal of the center axis.

As shown in FIGS. 4 and 6A, an adjustment screw 26 is provided with a screw head 28 and a shaft 32. The adjustment screw 26 includes a threaded portion 30 and a circular holding disk 34, each having larger diameters than the shaft 32, at opposite ends of the shaft 32. The adjustment screw 26 is arranged such that the plate assembly 14 may be aligned or properly adjusted in a vertical direction relative to the base plate 18. In one embodiment, the threaded portion 30 operatively engages the screw thread opening 36 of the plate assembly 14, and the shaft 32 is situated between the open slot 60 of base plate 18 and secured thereto in a vertical direction by the threaded portion 30 and the disk 34. Turning the screw head 28 of the adjustment screw 26 results in the top portion 35 of the connecting plate assembly 14 and the base plate 18 being titled with respect to each other about the curved region 41 of the elongated portion 42 such that the top portion 35 of the connecting plate assembly 14 is angularly displaced in a vertical direction relative to the base plate 18. Such angular displacement being centered at the curved region 41 of the elongated portion 42.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. An adjustable hinge fixture comprising:

a base plate for adjustable fixation to an article of furniture;

a connecting plate assembly including a generally U-shaped cross-section formed by a top portion and a pair of spaced apart side walls, the connecting plate assembly having a projection through a curved region to a lower portion of the projection positioned between the side walls and generally parallel to the top portion, the curved region being elastically deflectable along a bending axis to permit the lower and top portions to move relative to each other, wherein the lower portion is adjustably connected to the base plate;

a hinge arm pivotably connected to the connecting plate assembly with a first pin having a first longitudinal axis;

a hinge cup pivotably connected to the hinge arm with a second pin having a second longitudinal axis;

wherein the bending axis is generally parallel to the first longitudinal axis and the second longitudinal axis; and, an adjustment screw operable to move the connecting plate assembly relative to the base plate about the curved region of the connecting plate assembly.

2. The adjustable hinge fixture of claim 1, wherein the base plate includes an open slot adapted to receive the adjustment screw, the adjustment screw being positioned in a threaded opening of the top portion and adjustably secured within the open slot.

3. The adjustable hinge fixture of claim 2, wherein the connecting plate assembly includes an eccentric operator configured to allow adjustment of the connecting plate assembly along the base plate in a longitudinal direction.

4. The adjustable hinge fixture of claim 3, wherein the base plate includes a boss positioned between the U-shaped cross section operatively allowing slideable movement of the connecting plate assembly along the base plate in a longitudinal direction.

5. The adjustable hinge fixture of claim 4, wherein the eccentric operator is mounted in the lower portion and projects into a hole formed in the base plate, and wherein the eccentric operator is adapted for adjustably connecting the connecting plate assembly to the base plate.

6. The adjustable hinge fixture of claim 5, wherein the eccentric operator includes a screw head, and wherein an opening formed on the top portion is positioned above the screw head.

7. The adjustable hinge fixture of claim 6, wherein adjustment of the screw head moves the connecting plate assembly along the base plate in a longitudinal direction.

8. The adjustable hinge fixture of claim 5, wherein the eccentric operator includes an off-center cam that is secured in the base plate.

9. The adjustable hinge fixture of claim 8, wherein the off-center cam is riveted in the base plate.

10. The adjustable hinge fixture of claim 8, wherein the off-center cam is bolted in the base plate.

11. The adjustable hinge fixture of claim 4, wherein the base plate includes first and second wing portions extending transversely on opposite sides thereof, the first and second wing portions each being adapted for receiving fixing screws for securing the base plate to the article of furniture.

12. The adjustable hinge fixture of claim 11, wherein the first and second wing portions each include an elongated slot extending transversely and adapted to receive a fixing screw for securing the base plate to the article of furniture and operable to allow adjustment of the base plate in a transverse direction.

13. The adjustable hinge fixture of claim 12, wherein the first and second wing portions each further include a downward extending flap which is configured to rest against a side of the article of furniture.

14. The adjustable hinge fixture of claim 1 further comprising;

a four-bar linkage having a first end pivotally connected to the connecting plate assembly and a second end pivotally connected to a hinge cup mounted in a door, wherein the adjustable hinge fixture provides an adjustable space between the article of furniture and the door.

15. An adjustable hinge comprising:

an adjustable hinge fixture including:

a base plate for adjustable fixation to a first article of furniture, a connecting plate assembly including a generally U-shaped cross-section formed by a top portion and a pair of spaced apart side walls, the connecting plate assembly having a projection through a curved region to a lower portion of the projection positioned between the side walls and generally parallel to the top portion, the curved region being elastically deflectable alone a bending axis to permit the lower and top portions to move relative to each other, wherein the lower portion is adjustably connected to the base plate, and an adjustment screw operable to move the connecting plate assembly relative to the base plate about the curved region of the connecting plate assembly;

a door-related part secured to a second article of furniture;

a linkage means, having a set of pins with a set of parallel longitudinal axes, for movably interconnecting the door-related part and the adjustable hinge fixture; and, wherein the longitudinal axes of the set of pins and the bending axis are generally parallel.

16. The adjustable hinge of claim 15, wherein the connecting plate assembly includes an eccentric operator configured to allow adjustment of the connecting plate assembly along the base plate in a longitudinal direction.

17. The adjustable hinge of claim 16, wherein the base plate includes first and second wing portions extending transversely on opposite sides thereof, the first and second wing portions each including an elongated slot extending transversely and adapted to receive a fixing screw for securing the base plate to the first article of furniture and operable to allow adjustment of the base plate in a transverse direction.

18. The adjustable hinge of claim 15, wherein the adjustable hinge has an adjustable gap between the first and second articles of furniture and wherein the linkage means further comprises a four-bar linkage.

19. The adjustable hinge of claim 18, wherein the adjustable hinge comprises a self-closing adjustable hinge.

* * * * *